United States Patent [19]

Urban et al.

[11] Patent Number: 4,520,720

[45] Date of Patent: Jun. 4, 1985

[54] STRAP CHUTE FOR AUTOMATIC STRAPPING MACHINE

[75] Inventors: Clement A. Urban, Willow Springs; Gale W. Huson, Glenview, both of Ill.

[73] Assignee: Signode Corporation, Glenview, Ill.

[21] Appl. No.: 493,676

[22] Filed: May 11, 1983

[51] Int. Cl.[3] ..... B65B 13/04

[52] U.S. Cl. ..... 100/26

[58] Field of Search ..... 100/25, 26; 53/589

[56] References Cited

U.S. PATENT DOCUMENTS

| | | | |
|---|---|---|---|
| 3,060,840 | 10/1962 | Van De Bilt | 100/26 |
| 3,279,354 | 10/1966 | Dickens | 100/26 |
| 3,536,430 | 10/1970 | Kurihara | 100/26 X |
| 3,572,237 | 3/1971 | Kurihara | 100/26 |
| 3,768,396 | 10/1973 | Coleman | 100/26 |
| 3,831,512 | 8/1974 | Johnson | 100/26 |
| 3,889,585 | 6/1975 | Morrow | 100/26 |
| 3,899,963 | 8/1975 | Tremper | 100/25 |
| 4,011,808 | 3/1977 | Aoki et al. | 100/26 |

FOREIGN PATENT DOCUMENTS

| | | |
|---|---|---|
| 1211102 | 2/1966 | Fed. Rep. of Germany . |
| 94596 | 12/1973 | Japan . |

OTHER PUBLICATIONS

"Operation", Parts and Safety Manual/Signode/Model MCD-710 Power Strapping Machine, published by Signode Corporation, 3600 West Lake Avenue, Glenview, Illinois 60025, with a date code of 186162 Rev. 9/82.

*Primary Examiner*—Billy J. Wilhite

*Attorney, Agent, or Firm*—Dressler, Goldsmith, Shore, Sutker & Milnamow, Ltd.

[57] ABSTRACT

A strap chute is provided for an automatic strapping machine and comprises a plurality of sections adapted to be assembled together with the machine to form a loop-like strap guide path around an article to be strapped. Each section comprises a mounting frame having a pair of opposed fulcrum members, a pair of strap guides each having at least an outer retaining wall for guiding and retaining the strap when the strap guides are located in a closed position, and a biasing means for biasing the strap guides into the closed position. Each strap guide includes a lever member disposed adjacent one of the fulcrum members of the frame to accommodate pivoting movement of the strap guide between the closed position and an open position. The biasing means is disposed between the lever members of the strap guides for biasing each strap guide lever member against one of the fulcrum members and for pivoting the lever members so as to normally maintain the strap guides in the closed position.

15 Claims, 9 Drawing Figures

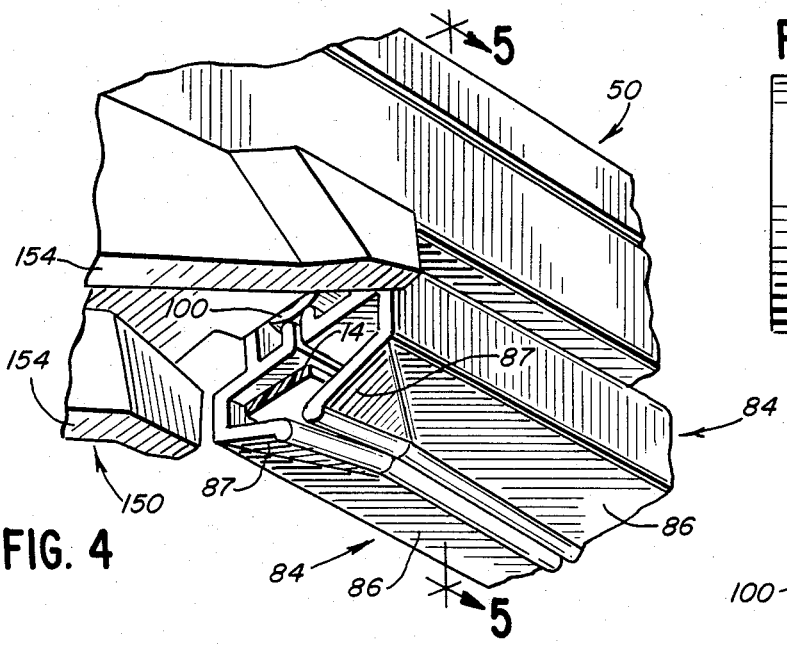
FIG. 4
FIG. 6
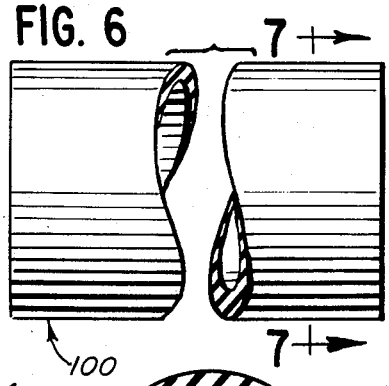
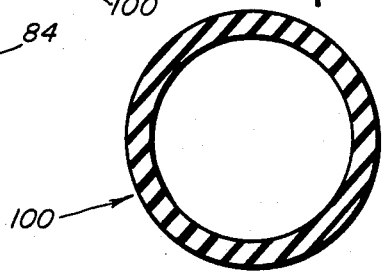
FIG. 7
FIG. 5
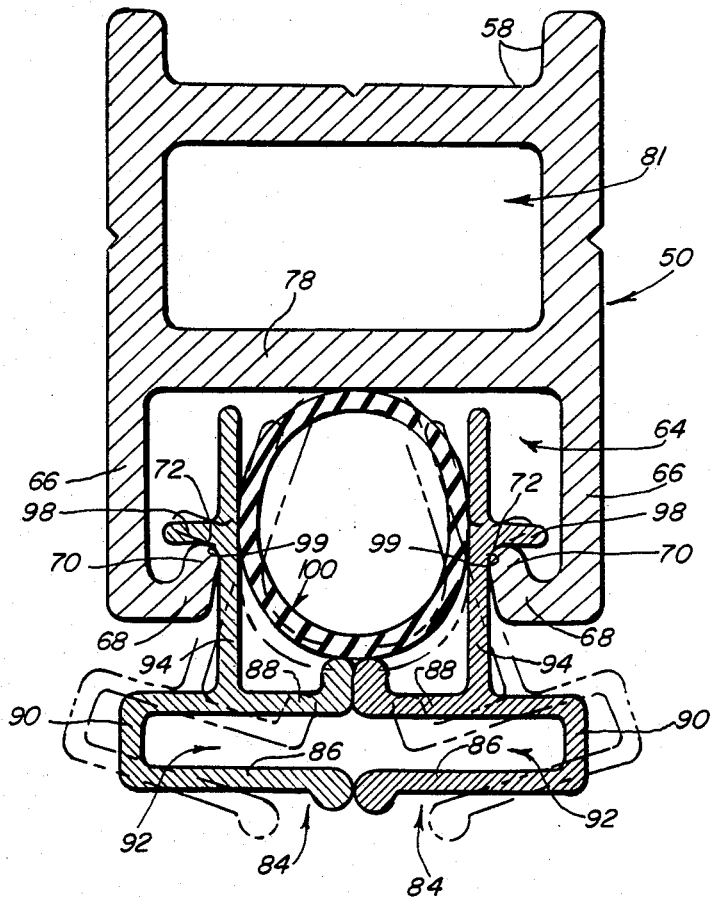

STRAP CHUTE FOR AUTOMATIC STRAPPING MACHINE

TECHNICAL FIELD

This invention relates to apparatus for strapping an article with a tensioned loop of strap, and more particularly to a chute for guiding the strap around the article.

BACKGROUND OF THE INVENTION AND TECHNICAL P PROBLEMS POSED BY THE PRIOR ART

The present invention has been developed for incorporation in the type of automatic strapping machine in which a length of strap is guided in a chute around an article at a packaging station. Typically, the chute defines a generally rectangular opening in which the article is positioned during the strapping operation.

Means are provided in the chute for initially guiding and retaining the strap in the chute so that the strap cannot fall or be pulled inwardly against the article until after the loop has been formed. Typically, the chute is larger than the article to be strapped so as to accommodate various sizes of articles and thus, such strap guiding and retaining means function to initially maintain the strap in the largest possible loop configuration and, of course, function to permit the strap to be fed around the article without impinging upon or snagging upon the article.

After the strap loop has been formed, tension is applied to the strap to constrict the strap loop about the article and the overlapping strap ends are secured by conventional means. Various systems have been designed for permiting the strap to be released from the strap guiding and retaining means during the tensioning step so that the strap can be drawn tight against the article.

One type of system for initially guiding and retaining the strap in a chute is illustrated in the U.S. Pat. Nos. 3,572,237 and 3,536,430. These patents disclose an automatic strapping machine in which a yoke or chute defines a channel for receiving the strap and in which flexible flange members extend inwardly to overlie side portions of the strap and initially maintain the strap in the channel when the strap is fed in the chute around the article. Subsequently, when the strap is tensioned, the strap deforms the flexible flange members outwardly as the strap is pulled out of the channel and free of the flexible flange members into tight engagement around the article.

Another approach is disclosed in the U.S. Pat. Nos. 3,060,840 and 4,011,808. The apparatus described in these patents has a chute with a movable guide member defining a channel for receiving a strap or binding wire. During the initial step of feeding the strap or wire around the chute, the entire guide member is maintained in a closed position against a blocking member to cover the strap or wire receiving channel and to thereby prevent the strap or wire from leaving the channel. Subsequently, when the strap or wire is tensioned about the article, the guide member is moved to an open position spaced away from the blocking member to permit the strap or wire to be pulled out of the channel. In the machine disclosed in U.S. Pat. No. 3,060,840, the guide member is positively moved from the closed position to the open position by a hydraulic cylinder-piston actuator. In the apparatus disclosed in U.S. Pat. Nos. 4,011,808 the guide member is normally biased to the closed position and the tensioning of the strap overcomes the biasing mechanism to move the guide member to the open position for releasing the strap.

Finally, a common approach used today by a variety of manufacturers of automatic strapping machines employs rigid gate-type members which are normally biased closed over the strap guide channel during the feeding of the strap and which are opened in response to the tension on the strap when the strap is drawn tight about the article. Examples of this type of mechanism are shown in the U.S. Pat. Nos. 3,831,512; 3,889,585; and 3,899,963. In the machines disclosed in these patents, retainer gates are hingedly or pivotally mounted to the sides of the strap chute and have retaining flanges which are angled inwardly to overlie the strap receiving channel of the chute when the gates are in their normally biased-closed position. The tensioning of the strap forces the strap against the inwardly angled flanges of the gates and pivots the gates outwardly against the biasing means by an amount sufficient to permit release of the strap.

With the type of chute construction disclosed in the above-discussed U.S. Pat. Nos. 3,536,430 and 3,572,237, the flexible flange members are necessarily subjected to abrasion and flexing forces every time the strap is tensioned and pulled out of the chute. The components must thus be designed to withstand such abrasion and flexing. In addition, the flexible flange retaining members that cover the strap channel are exposed to the articles that are placed within the chute. Care must be taken to avoid inadvertent or accidental impingement of the flexible flange members by the article, by tools, or by other apparatus that may be present in, or used around, the strapping machine location.

It would be desirable to provide a strap chute design in which the strap retaining mechanism had a thickness, configuration, and composition that would readily withstand abrasion and pull-out forces imposed by the tensioning of the strap. Further, it would be advantageous if such an improved strap retaining mechanism had an increased capability for withstanding inadvertent impacts, misuse, and abuse which can occur from time to time under typical field conditions in which such automatic strapping machines are employed.

Although the approach employed in the apparatus disclosed in the above-discused U.S. Pat. Nos. 4,011,808 and 3,060,840 eliminates the need for exposed, flexible flange members, such apparatus requires a more complicated movable guide structure and mechanism for effecting the movement of the entire guide structure.

In contrast, the strap retaining systems disclosed in the above-discussed U.S. Pat. Nos. 3,831,512; 3,889,585; and 3,899,963 employ stationary guide channels and do not have exposed flexible flange members. However, such systems require the use of multi-piece hinge pin and spring biasing mechanisms which complicates the design and increases the manufacturing cost.

It would be desirable to provide an improved chute structure which could be rapidly assembled with fewer pieces and at less expense. Further, it would be desirable to provide such a structure in which the components could be relatively easily fabricated in predetermined lengths for accommodating a modular construction of the strap chute. A variety of different sizes of strap chutes could thus be assembled from a plurality of identical components.

SUMMARY OF THE INVENTION

A strap chute is provided for an automatic strapping machine in which strap is fed to form a loop around an article to be strapped, in which the strap is subsequently tightened around the article, and in which the strap is then joined at overlapping portions in the tight loop.

The strap chute comprises a plurality of sections for being joined together with the machine to define a path along which the strap is guided as the strap is fed in the loop. Each section includes a mounting frame having a pair of opposed fulcrum members each defining a fulcrum spaced from the other fulcrum.

Each section also includes a pair of strap guides each having at least an outer retaining wall for guiding and retaining the strap when the strap guides are located in a closed position wherein the outer retaining walls are in close approximation. Each strap guide has a lever member disposed adjacent one of the fulcrum members to accomodate pivoting movement of the strap guide between the closed position and an open position displaced from the closed position wherein the strap guide outer retaining walls are spaced apart an amount sufficient to accommodate the passage of the strap therepast when the strap is tightened.

Each section also includes means disposed between the lever members for biasing each strap guide lever member against one of the fulcrum members and for pivoting each lever member so as to normally maintain the strap guides in the closed position. However, after the strap loop is formed, tightening of the strap will cause the strap to bear against the strap guide outer retaining walls and pivot the strap guides into the open position to release the strap.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 4 is a greatly enlarged, fragmentary, perspective view taken generally along the plane 4—4 in FIG. 3;

FIG. 5 is an even more greatly enlarged, cross-sectional view taken generally along the plane 5—5 in FIG. 4;

FIG. 6 is a side view of the biasing member removed from a chute section;

FIG. 7 is a cross-sectional view taken generally along the plane 7—7 in FIG. 6;

DESCRIPTION OF THE PREFERRED EMBODIMENT

While this invention is susceptible of embodiment in many different forms, the specification and the accompanying drawings disclose only one specific form as an example of the use of the invention. The invention is not intended to be limited to the embodiment illustrated, and the scope of the invention will be pointed out in the appended claims.

Many of the figures illustrating the preferred embodiment of the apparatus show structural details and mechanical components that will be recognized by one skilled in the art. However, the detailed descriptions of many of such components are not necessary to an understanding of the invention, and accordingly, are not herein presented.

Figure 2:
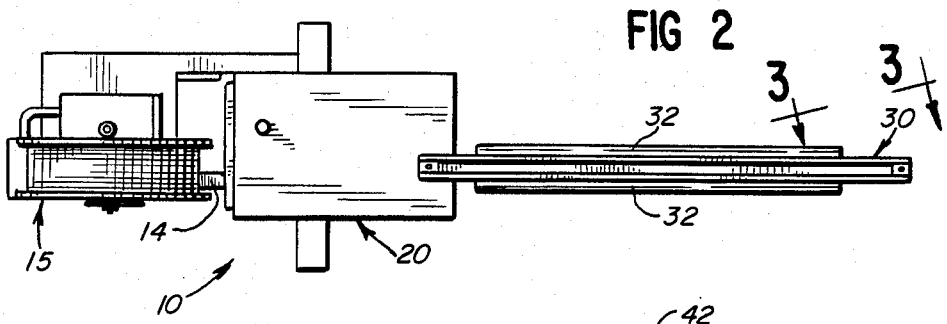
FIG. 2 is a top plan view of the machine illustrated in FIG. 1.
Figure 1:
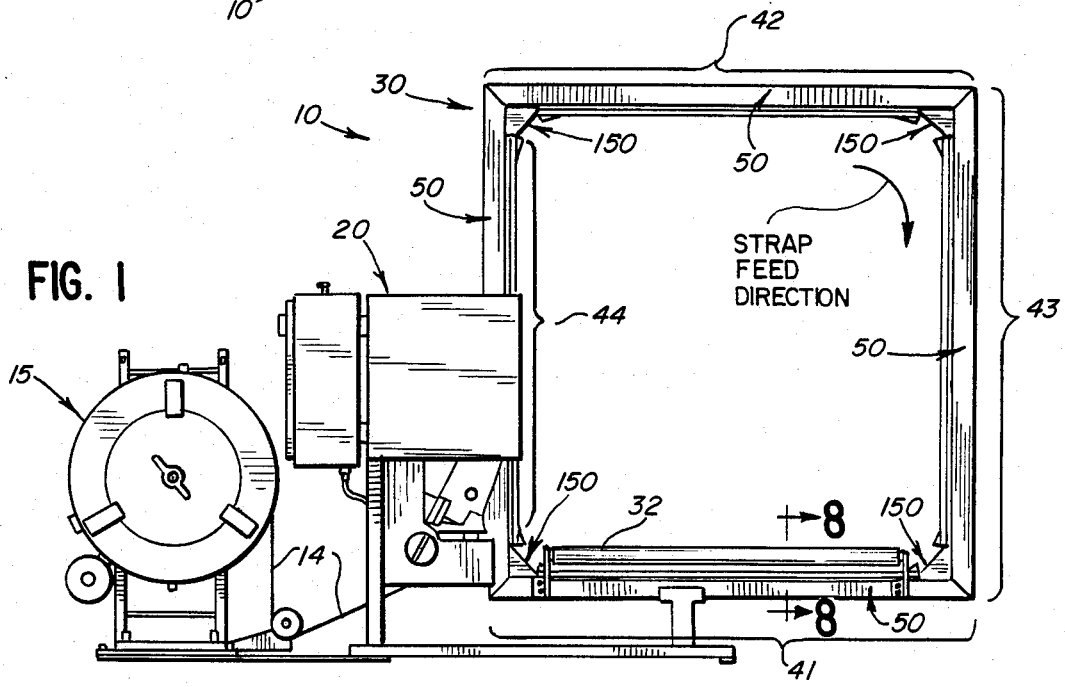
FIG. 1 is a side elevation view of an automatic strapping machine having a strap chute in accordance with the present invention.

FIGS. 1 and 2 illustrate the overall arrangement of a strapping machine 10. The machine 10 may include a number of conventional mechanisms which are identical to those included in an existing automatic strapping machine sold by Signode Corporation, 3600 West Lake Avenue, Glenview, Ill. 60025 under the designation "Model MCD-710". In this description, only such portions of the mechanisms of that commercial automatic strapping machine as are relevant to the present invention have been illustrated in detail, those portions being described only in sufficient detail herein so as to afford an understanding of their relation to the teachings of the present invention. The Model MCD-710 automatic strapping machine is described in detail in the "*Operation, Parts and Safety Manual/Model MCD-710 Automatic Strapping Machine*" published by Signode Corporation with a publication code of 186162 and a revision date of "9/82." The deescription of the machine disclosed in that publication is incorporated herein by reference to the extent pertinent and to the extent not inconsistent herewith. Of course, it is to be understood that the apparatus of the present invention may also be used with other chute type strapping machines.

The machine 10 includes a supply of strap 14 maintained on a strap dispensing reel assembly 15. The present invention is especially adapted for use with this machine 10 when operating with strap 14 that is conventionally fabricated from thermoplastic materials such as nylon, polypropylene, and polyester materials. The thickness of the strap may typically be between about 0.254 mm. and about 0.889 mm. and the width of the strap may typically range between about 5.00 mm. and about 9.53 mm. The strap chute design of the present invention has been found to work particularly well with the lighter gauge or thinner sizes of such commercially available strap.

Figure 8:
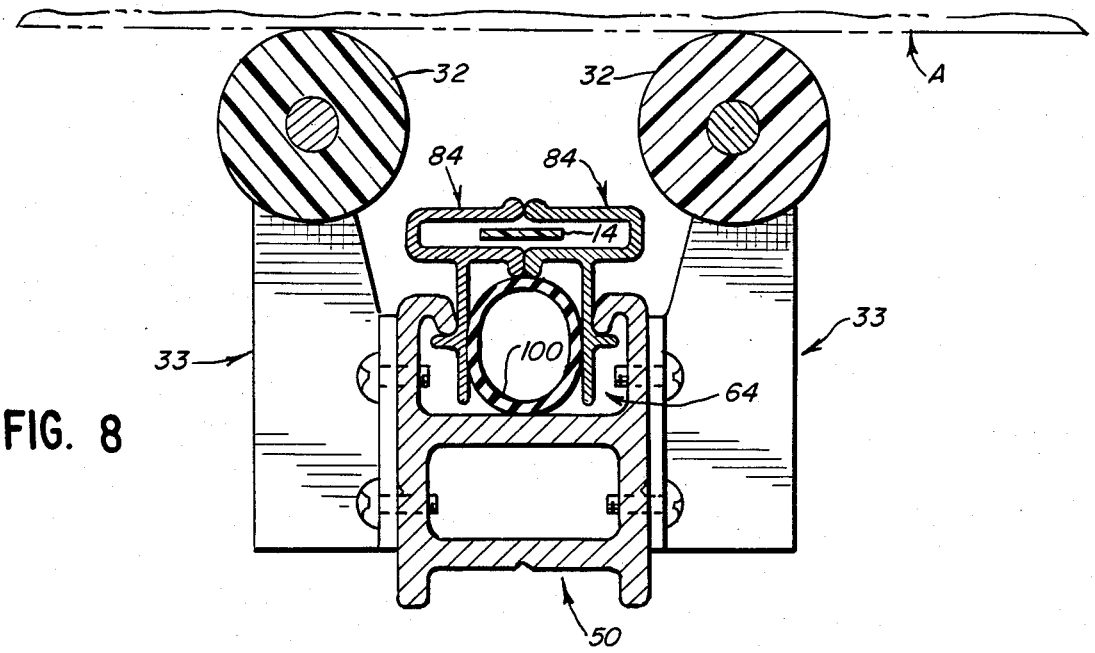
FIG. 8 is an enlarged, cross-sectional view taken generally along the plane 8—8 in FIG. 1.

The strap 14 extends from the strap dispensing reel assembly 15 into a combined feeding, tensioning, sealing, and strap cutting assembly 20. The assembly 20 is located adjacent, and partially around, a portion of a strap chute 30 which, in FIG. 1, is seen to have a generally rectangular configuration defining an article receiving and strapping station. As best illustrated in FIGS. 1 and 8, the strapping station may include support or friction rolls 32 on which an article A (shown in dashed line in FIG. 8 only) can be supported during the strapping operation. The rolls 32 may be mounted with suitable brackets 33 to the lower portion of the chute 30 as best illustrated in FIGS. 1 and 8. It is to be understood that in a commercial installation the article A may be conducted to and from the strapping station by means of a suitable intermittently operable conveyor or by a series of live rolls as is customary in the art.

The assembly 20 functions to first feed the strap 14 from the strap dispensing assembly 15 into the chute 30 and then around the chute (in the clockwise direction as viewed in FIG. 1) so as to form a loop around the article to be strapped with overlapping portions of the strap 14 being located at the assembly 20. Conventional mechanisms are also provided in the assembly 20 for gripping the free end of the strap 14, for then tensioning the strap tight about the article by withdrawing the strap in the direction opposite to the feed direction, for subsequently joining the overlapping portions of the strap (as by friction-fusion welding or by some other suitable means), and lastly for severing the trailing portion of the strap from the tensioned and sealed loop about the article.

Considering now in detail the strap chute 30 of the present invention, and with reference to FIG. 1, the chute 30 is seen to comprise at least four sides, runs, or sections: a lower horizontal run 41, an upper horizontal run 42, and two vertical runs 43 and 44. In the embodiment illustrated in FIG. 1, each of the three runs or sections 41–43 is shown as including, inter alia, a single external support member or frame 50. Each of these frames 50 is substantially identical in each of the three sections 41–43. The frame 50 in the vertical section 44 adjacent the assembly 20 is generally similar to the frames 50 in the other three sections 41–43 except that it has appropriate cut-outs (or may be in two pieces) to accommodate passage of the strap 14 from the assembly 20 into the chute 30 and to accommodate the various mechanisms in the conventional assembly 20 that feed, tension, seal, and sever the strap.

Although the frames 50 are illustrated as each being a unitary member extending the length of a section or run of the chute 30, it is to be realized that each frame 50 may be provided, if desired, as a plurality of generally identical frames mounted end-to-end in separate sections along each side of the chute 30. With such a design, the frames 50 may be fabricated in standardized lengths for use in assembling strap chutes of a variety of different sizes and in a variety of different rectangular (or other) configurations.

Figure 3:
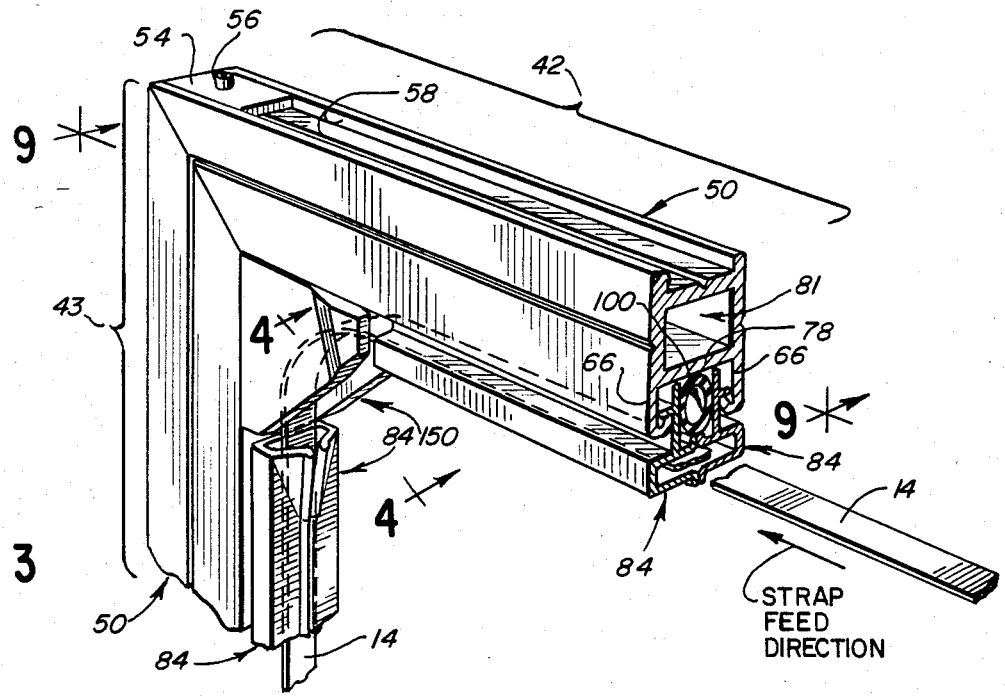
FIG. 3 is a greatly enlarged, fragmentary, perspective view of a corner of the strap chute taken from behind the strap chute generally along the plane 3—3 in FIG. 2.
Figure 9:
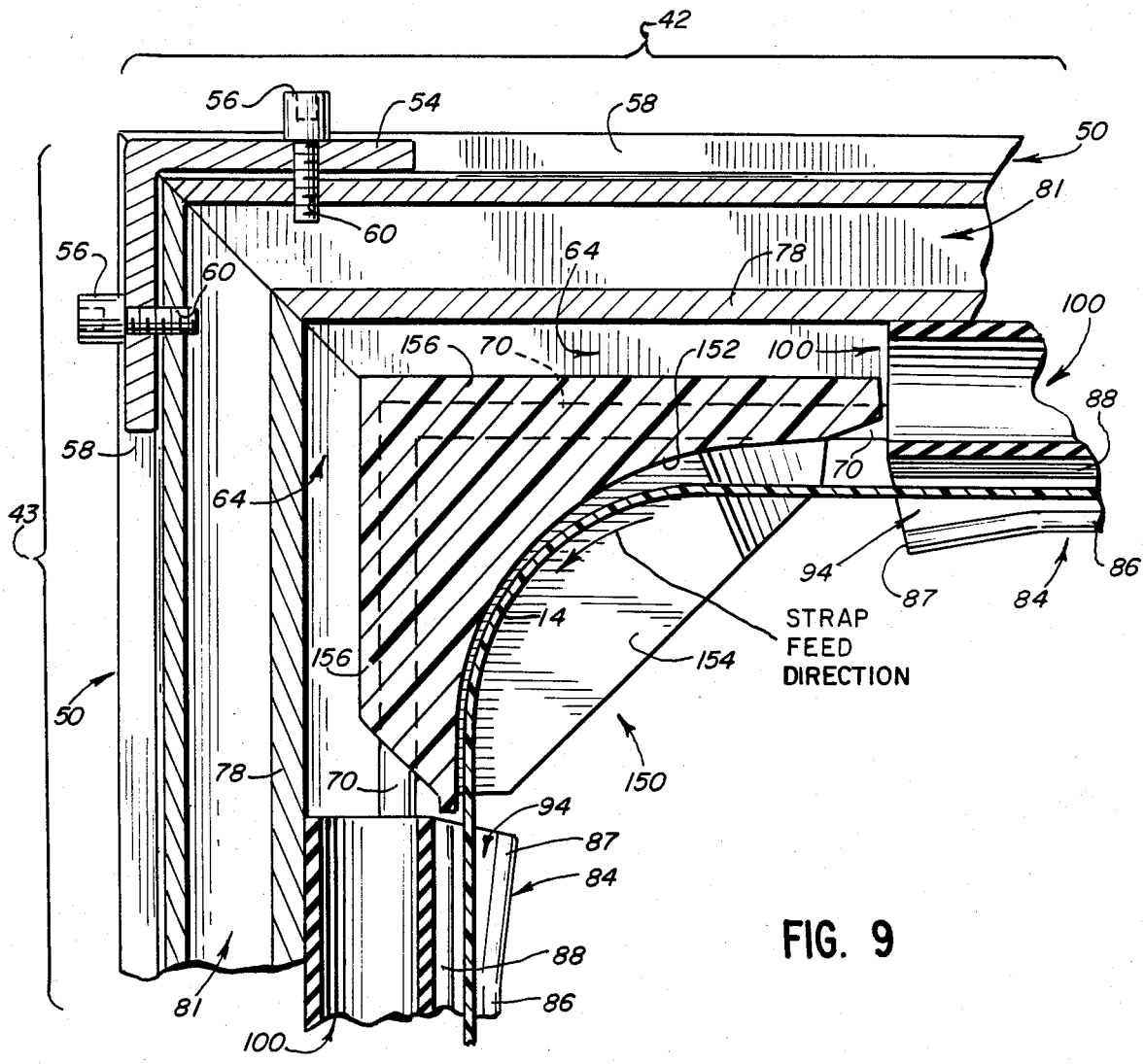
FIG. 9 is a greatly enlarged, fragmentary, cross-sectional view taken generally along the plane 9—9 in FIG. 3.

As best illustrated in FIGS. 1 and 3, the ends of the two frames 50 at each corner of the chute 30 are preferably mitered at a 45 degree angle to accommodate formation of a joint at the corner and are secured together by means of a suitable corner bracket 54 with screws 56. As best illustrated in FIGS. 3 and 9, each frame 50 defines a channel 58 for receiving a leg of the bracket 54 and each frame 50 defines a threaded aperture 60 adjacent the miter joint end for engaging one of the screws 56.

Each frame 50 has a unique structure as best illustrated in FIG. 5. Specifically, each frame 50 is shaped in cross section so as to define a mounting channel 64 having opposite side walls 66 with a lip 68 extending inwardly from each side wall 66. The distal end of each lip 68 is a fulcrum member 70 which defines a convex, arcuate, fulcrum surface 72. For reasons that will become apparent hereinafter, the members 70 can be regarded as defining or functioning as spaced-apart, elongate, fulcrums.

Each frame 50 also includes a rear wall 78 defining the bottom of the mounting channel 64 between the mounting channel side walls 66. Preferably, each frame 50 is also manufactured with an interior cavity 81 to reduce the amount of material required. Each frame 50 is preferably an aluminum extrusion which can be made relatively inexpensively.

The above-described frame structure accommodates a pair of strap guides 84 as best illustrated in FIGS. 3 and 5. Each strap guide 84 has at least an outer retaining wall 86 for guiding and retaining the strap 14 when the strap guides 84 are located in a closed position wherein the outer retaining walls 86 are in close approximation as illustrated in solid lines in FIG. 5. Each strap guide 84 also preferably includes an inner wall 88 for guiding the strap 14. As best illustrated in FIGS. 3 and 5, the outer retaining wall 86 is joined to the inner wall 88 by an end wall 90 to define a strap guide channel 92. The channel 92 has an opening facing inwardly to communicate with the opening of the other strap guide channel 92 when the strap guides 84 are in the closed position illustrated in solid lines in FIG. 5.

Each strap guide 84 also includes a lever member 94 disposed against one of the fulcrums 70 in a preferably unpinned relationship. This accommodates pivoting movement of each strap guide 84 between the closed position and an open position (illustrated in dashed lines in FIG. 5) that is displaced from the closed position.

Preferably, the lever member 94 of each strap guide 84 extends from the strap guide inner wall 88 and projects generally perpendicularly therefrom into the frame mounting channel 64. Also, as best illustrated in FIG. 5, each strap guide lever member 94 preferably includes a rib 98 extending outwardly so as define a concave receiving craddle or surface 99 for receiving the fulcrum surface 72 of the fulcrum 70.

As best illustrated in FIGS. 3, a biasing means 100 is disposed between the lever members 94 for biasing each strap guide lever member 94 against one of the fulcrums 70 and for pivoting each lever member 94 so as to normally maintain the strap guides 84 in the closed position. In the preferred embodiment illustrated, the biasing means 100 is an elongate, hollow, flexible, tubular member or tube of a rubber or elastomeric material which is disposed within the mounting channel 64 of the frame 50.

As best illustrated in FIGS. 5–7, the biasing means member 100 is hollow and has a generally cylindrical configuration before assembly in the frame 50. Upon assembly, the member 100 is compressively engaged and restrained between the strap guide lever members 94 in the frame channel 64. The rear wall 78 of the frame defining the bottom of the mounting channel 64 limits the rearward position of the biasing means member 100.

The assembled sections 41–44 (each comprising a frame 50, the two strap guides 84, and the biasing means member 100) are preferably devoid of pin members connecting the guides 84 to the frames. The two strap guides 84 in each frame 50 are maintained in the frame by the biasing means member 100 which forces each of the strap guides 84 into engagement with the frame 50, and particularly, into an engagement wherein the lever members 94 can pivot about the fulcrums 70.

During the step of tensioning the strap 14 tight about the article, the strap 14 is pulled against the outer retaining walls 86 of the strap guides 84. This causes the strap guides 84 to pivot away from each other an amount sufficient to accomodate the passage of the strap therepast. This open position of the strap guides is illustrated in dashed lines in FIG. 5 and permits release of the strap 14 so that it can be drawn tight about the article.

To faciliate the feeding of the strap 14 around the corners of the chute 30, a corner block 150 is provided in each corner as best illustrated in FIGS. 1, 3, 4, and 9. The corner block 150 defines an arcuate guide surface 152 (FIG. 9) which generally merges on either end of the block with the strap guide channel 92 of the adjacent strap guide 84. As best illustrated in FIGS. 4 and 9, the block 150 is also provided with a pair of side walls 154 for guiding the strap 14 laterally in the corner. The blocks 150 are preferably fabricated from a suitable material such as a synthetic thermoplastic material. To further accommodate the feeding and subsequent tensioning of the strap (in the clockwise direction as viewed in FIG. 1 and in the counterclockwise direction as viewed in FIG. 9), the outer retaining wall 86 at each end of each strap guide 84 has an outwardly angled portion 87 (FIGS. 1, 4, and 9).

Each corner block 150 is held in position at a corner of the chute 30 without screws or other fasteners. To this end, the corner block 150 is provided with a unique T-shaped portion along each leg or side of the block for being received in the adjacent frame mounting channel 64. In FIG. 9, the crossbar sections 156 of the "T" portions on the corner block 150 are seen to be positioned in the frame mounting channels 64 and retained in position by the underlying, inwardly extending frame fulcrum members 70.

As best illustrated in FIGS. 3 and 5, the strap guides 84 are seen to be mounted in the frame 50 without bolts, screws, pins, or other pin-type fasteners. Each chute section is thus devoid of any pin members connecting the guides 84 to the frames 50 and this accommodates quick and easy assembly of the section components.

To assemble each section, the pair of strap guides 84 are positioned in adjacent relationship as illustrated in FIG. 5 with the biasing means flexible tube 100 between the lever members 94. By initially compressing the lever members inwardly a sufficient amount against the tubular member 100, the lever members 94 can be easily inserted into the frame mounting channel 64 from the end of the frame, and the ribs 98 of the strap guides 84 can be properly positioned behind the fulcrum members 70.

The completed sections (each comprising the frame 50, the biasing means tube 100, and the pair of strap guides 84) can be then secured at the miter joint corners with the corner blocks 150, brackets 54, and mounting screws 56 as illustrated in FIG. 9.

It is seen that the strap guides 84 and the biasing means 100 cannot become accidentally or inadvertently dislodged from the frame 50 once they have been properly assembled. In the upper horizontal section or run 42 (FIG. 1), the guides 84 are prevented from falling out of the frame 50 by the engagement of each guide rib 98 (FIG. 5) with the fulcrum member 70, which engagement is maintained by the outwardly directed forces of the biasing means 100. A similar engagement prevents dislodgement of the components in the lower horizontal section 41 as well as in the vertical sections 43 and 44.

In the vertical sections 43 and 44, the lower (bottom) ends of the strap guides 84 may rest upon an appropriate support (not illustrated) or upon the end of a corner member 150, especially after a period of operation of the machine 10 which could generate sufficient vibration to cause the strap guides 84 to slide downwardly a fraction of an inch as may be permitted by any clearance initially provided during the assembly of the vertical sections of the chute 30. However, such support of the lower ends of the strap guides 84 in the vertical sections 43 and 44 will be accompanied by only relatively low frictional forces having no deleterious affect on the pivoting movement of the strap guides 84 between the open and closed positions.

Although FIG. 5 illustrates the outer retaining walls 86 of each strap guide 84 in an almost abutting relationship when the strap guides are in the closed position, it is to be realized that some amount of clearance may exist in the closed position between the outer retaining walls 86 so long as such clearance is insufficient to permit passage of the strap therepast during the feeding of the strap.

Although FIG. 5 shows the inner walls 88 of the strap guides 84 in abutting relationship, it is to be realized that such an abutting relationship is not necessary. For example, if abutment members (not illustrated) were provided in the frame 50 at suitable locations to limit the pivoting movement of the lever members 94, the strap guides 84 could be maintained at some small, spaced-apart distance from each other when the strap guides were in the normally closed position so long the spacing was sufficiently small to permit proper guiding of the strap 14 within the guide channels 92. By the same token, the inner walls 88 could be shorter so as to provide the small space between them.

It will be readily observed from the foregoing detailed description of the invention and from the illustrated embodiment thereof that numerous variations and modifications may be effected without departing from the true spirit and scope of the novel concepts or principles of the invention.

What is claimed is:

1. A strap chute for an automatic strapping machine in which a strap is fed to form a loop around an article to be strapped, in which the strap is then tightened around the article, and in which the strap is subsequently joined at overlapping portions in the tight loop, said strap chute comprising a plurality of sections for being joined together with said machine to define a path along which said strap is guided as the strap is fed in said loop, each said section including (a) a mounting frame having a pair of opposed fulcrum members each defining a fulcrum spaced from the other fulcrum;

(b) a pair of strap guides each having at least an outer retaining wall for guiding and retaining said strap when said strap guides are located in a closed position wherein said outer retaining walls are in close approximation, each said strap guide having a lever member disposed adjacent one of said fulcrum members in an unpinned relationship to accommodate pivoting movement of said strap guides between said closed position and an open position displaced from said closed position wherein said strap guide outer retaining walls are spaced apart an amount sufficient to accommodate the passage of said strap therepast when said strap is tightened; and (c) biasing means disposed in compression between said strap guide lever members for continuously subjecting said strap guide lever members to outwardly directed forces for biasing each said strap guide lever member against one of said fulcrum members and for pivoting said lever members so as to normally maintain said strap guides in said closed position whereby, after said strap loop is formed, the tightening of said strap causes said strap to bear against said strap guide outer retaining walls and pivot said strap guides into said open position to release said strap.

2. A strap chute for an automatic strapping machine in which a strap is fed to form a loop around an article to be strapped, in which the strap is then tightened around the article, and in which the strap is subsequently joined at overlapping portions in the tight loop, said strap chute comprising a plurality of sections for being joined together with said machine to define a path along which said strap is guided as the strap is fed in said loop, each said section including (a) a mounting frame having a pair of opposed fulcrum members each defining a fulcrum spaced from the other fulcrum, each said fulcrum member having a convex, arcuate, fulcrum surface;

(b) a pair of strap guides each having at least an outer retaining wall for guiding and retaining said strap when said strap guides are located in a closed position wherein said outer retaining walls are in close approximation, each said strap guide having a lever member disposed adjacent one of said fulcrum members in an unpinned relationship to accommodate pivoting movement of said strap guides between said closed position and an open position displaced from said closed position wherein said strap guide outer retaining walls are spaced apart an amount sufficient to accommodate the passage of said strap therepast when said strap is tightened, each said lever member defining a concave, arcuate, receiving surface for receiving said fulcrum surface of one of said fulcrum members; and (c) biasing means disposed between said strap guide lever members for biasing each said strap guide lever member receiving surface against the fulcrum surface of one of said fulcrum members and for pivoting said lever members so as to normally maintain said strap guides in said closed position whereby, after said strap loop is formed, the tightening of said strap causes said strap to bear against said strap guide outer retaining walls and pivot said strap guides into said open position to release said strap.

3. A strap chute for an automatic strapping machine in which a strap is fed to form a loop around an article to be strapped, in which the strap is then tightened around the article, and in which the strap is subsequently joined at overlapping portions in the tight loop, said strap chute comprising a plurality of sections for being joined together with said machine to define a path along which said strap is guided as the strap is fed in said loop, each said section including (a) a mounting frame having a pair of opposed fulcrum members each defining a fulcrum spaced from the other fulcrum, said mounting frame defining a mounting channel having opposite side walls with each said side wall having an inwardly extending lip with each said fulcrum member being defined by the distal end of one of said lips;

(b) a pair of strap guides each having at least an outer retaining wall for guiding and retaining said strap when said strap guides are located in a closed position wherein said outer retaining walls are in close approximation, each said strap guide having a lever member disposed adjacent one of said fulcrum members in an unpinned relationship to accommodate pivoting movement of said strap guides between said closed position and an open position displaced from said closed position wherein said strap guide outer retaining walls are spaced apart an amount sufficient to accommodate the passage of said strap therepast when said strap is tightened; and (c) biasing means disposed between said strap guide lever members for biasing each said strap guide lever member against one of said fulcrum members and for pivoting said lever members so as to normally maintain said strap guides in said closed position whereby, after said strap loop is formed, the tightening of said strap causes said strap to bear against said strap guide outer retaining walls and pivot said strap guides into said open position to release said strap.

4. The strap chute in accordance with claim 3 in which said biasing means is an elongate, tubular, flexible member disposed within said frame mounting channel and compressively restrained between said strap guide lever members.

5. The strap chute in accordance with claim 4 in which said frame includes a rear wall defining the bottom of said mounting channel between said mounting channel side walls for limiting the rearward position of said flexible member.

6. A strap chute for an automatic strapping machine in which a strap is fed to form a loop around an article to be strapped, in which the strap is then tightened around the article, and in which the strap is subsequently joined at overlapping portions in the tight loop, said strap chute comprising a plurality of sections for being joined together with said machine to define a path along which said strap is guided as the strap is fed in said loop, each said section including (a) a mounting frame having a pair of opposed fulcrum members each defining a fulcrum spaced from the other fulcrum;

(b) a pair of strap guides each having at least an outer retaining wall for guiding and retaining said strap when said strap guides are located in a closed position wherein said outer retaining walls are in close approximation, each said strap guide having a lever member disposed adjacent one of said fulcrum members in an unpinned relationship to accommodate pivoting movement of said strap guides between said closed position and an open position displaced from said closed position wherein said strap guide outer retaining walls are spaced apart an amount sufficient to accommodate the passage of said strap therepast when said strap is tightened, each said strap guide also including an inner wall for guiding said strap, each said strap guide lever member being joined to said inner wall and each said strap guide outer retaining wall being joined to said inner wall to define a strap guide channel having an opening facing, and in communication with, the opening of the other strap guide channel when said strap guides are in said closed position; and (c) biasing means disposed between said strap guide lever members for biasing each said strap guide lever member against one of said fulcrum members and for pivoting said lever members so as to normally maintain said strap guides in said closed position whereby, after said strap loop is formed, the tightening of said strap causes said strap to bear against said strap guide outer retaining walls and pivot said strap guides into said open position to release said strap.

7. The strap chute in accordance with claim 6 in which said strap guide channels are located outside of said frame mounting channel.

8. For an automatic strapping machine in which a strap is fed to form a loop and tightened around an article and in which the strap is subsequently joined at overlapping portions in the tight loop, a strap chute comprising a plurality of sections for being joined together with said machine to define a path along which said strap is guided as the strap is fed in said loop, each said section including (a) a frame shaped in cross-section so as to define a mounting channel having opposite side walls with a lip extending inwardly from each said side wall to define a fulcrum surface;

(b) a pair of strap guides disposed at opposite sides of said mounting channel for movement between a closed strap retaining position and an open strap releasing position, each said strap guide defining a strap guide channel located outside of said frame mounting channel, each said strap guide channel being defined between opposing side walls with an opening facing, and in communication with, the opening of the other strap guide channel when said strap guides are each in said closed strap retaining position, each said strap guide also having a lever member extending from one of said strap guide channel side walls into said frame mounting channel adjacent one of said lips; and (c) means for biasing each said strap guide lever member outwardly to engage one of said fulcrum surfaces and to pivot each said strap guide about one of said fulcrum surfaces so as to normally maintain the two strap guide channels in close approximation in said closed strap retaining position for guiding and retaining said strap within said strap guide channels whereby, after said strap loop is formed, the tightening of said strap causes said strap to bear against a wall of each said strap guide and pivot each said strap guide about one of said fulcrum surfaces against said biasing means into said strap releasing position wherein said strap guide channels are spaced apart by a distance greater than at said closed strap retaining position and thereby release said strap.

9. The strap chute in accordance with claim 8 in which each strap guide is shaped in cross-section so as not to be accidently dislodged from said frame when initially assembled in said frame with said biasing means.

10. The strap chute in accordance with claim 9 in which each strap guide lever member includes a rib extending outwardly so as to define a receiving craddle for receiving one of said fulcrum surfaces.

11. The strap chute in accordance with claim 10 in which each said fulcrum surface is located in said mounting channel.

12. The strap chute in accordance with claims 8, 9, 10 or 11 in which said biasing means is a tube of elastomeric material disposed within said mounting channel.

13. The strap chute in accordance with claim 8, 9, 10, or 11 in which each said frame and strap guide is a separate extrusion.

14. The strap chute in accordance with claim 13 in which each said frame and strap guide is a separate aluminum extrusion.

15. The strap chute in accordance with claim 8 in which each said section is devoid of pin members connecting said strap guides to one of said frames and in which two of said strap guides are maintained in one of said frames by said blasing means which forces each said strap guide into engagement with said one frame.

* * * * *